US006499140B1

(12) United States Patent
Benjamin et al.

(10) Patent No.: US 6,499,140 B1
(45) Date of Patent: Dec. 31, 2002

(54) BIB HAVING A DURABLE POCKET STRUCTURE

(75) Inventors: Joyce M. Benjamin, Cincinnati, OH (US); George C. Dobrin, Mason, OH (US); Raymond S. Hamilton, Mason, OH (US); David W. Prichard, Cincinnati, OH (US); Henry W. McCusker, Cincinnati, OH (US); Adam M. Warren, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/085,286

(22) Filed: Feb. 28, 2002

Related U.S. Application Data

(63) Continuation-in-part of application No. 09/932,348, filed on Aug. 17, 2001, now Pat. No. 6,381,751.

(51) Int. Cl.[7] ..... A41B 13/10

(52) U.S. Cl. ..... 2/49.2; 2/49.4

(58) Field of Search ..... 2/49.1, 49.2, 49.3, 2/49.4, 49.5, 46, 48, 50, 51, 52, 247, 248, 252, 254, 250, 253, 251

(56) References Cited

U.S. PATENT DOCUMENTS

| | | | | | |
|---|---|---|---|---|---|
| 615,293 | A | * | 12/1898 | Maier | 2/49.2 |
| 2,164,369 | A | * | 7/1939 | Woolever | 2/49.1 |
| 2,517,357 | A | | 8/1950 | Schlegel, Jr. | |
| 3,407,407 | A | | 10/1968 | Hollander et al. | |
| 4,261,057 | A | | 4/1981 | Andersson | |
| 4,416,025 | A | | 11/1983 | Moret et al. | |
| 4,441,212 | A | | 4/1984 | Ahr et al. | |
| 4,445,231 | A | | 5/1984 | Noel | |
| 4,601,065 | A | | 7/1986 | Sigl et al. | |
| 4,646,365 | A | * | 3/1987 | Suprise et al. | 2/49.2 |
| 4,649,572 | A | * | 3/1987 | Roessler | 2/49.2 |
| 4,660,226 | A | | 4/1987 | Quillilng et al. | |
| 4,663,779 | A | | 5/1987 | Bible | |
| 4,706,303 | A | * | 11/1987 | Van Gompel et al. | 2/49.2 |
| 4,779,288 | A | | 10/1988 | Mack | |
| 5,218,721 | A | * | 6/1993 | Mathews et al. | 2/49.2 |
| 5,822,792 | A | * | 10/1998 | Reinhart, Jr. | 2/49.1 |
| 5,918,311 | A | | 7/1999 | Lampson et al. | |
| 6,058,506 | A | | 5/2000 | Reinhart, Jr. | |
| 6,105,165 | A | | 8/2000 | Johnson et al. | |
| 6,128,780 | A | | 10/2000 | Reinhart et al. | |
| 6,237,150 | B1 | | 5/2001 | Lucas | |
| 6,334,220 | B1 | * | 1/2002 | Frye | 2/49.2 |
| 6,363,530 | B1 | * | 4/2002 | Lampson et al. | 2/49.1 |

FOREIGN PATENT DOCUMENTS

| | | |
|---|---|---|
| GB | 707661 | 4/1954 |

* cited by examiner

*Primary Examiner*—Amy B. Vanatta
(74) *Attorney, Agent, or Firm*—Jay A. Krebs; Ken K. Patel

(57) ABSTRACT

The present invention provides a bib having an improved pocket. The bib has a body panel, a pocket panel forming a pocket space between the body panel and the pocket panel, and a third panel joined to the pocket panel. The third panel includes a flexible member joined thereto that helps to maintain the pocket space in an open configuration once the third panel is folded into the pocket space.

20 Claims, 6 Drawing Sheets

BIB HAVING A DURABLE POCKET STRUCTURE

CROSS REFERENCE

This application is a continuation-in-part of prior application Ser. No. 09/932,348, now U.S. Pat. No. 6,381,751, filed on Aug. 17, 2001.

FIELD OF THE INVENTION

The present invention is related to disposable bibs, and more particularly, to a bib having a pocket structure for receiving spilled liquid and solid materials.

BACKGROUND OF THE INVENTION

Disposable bibs are well known in the art. Such bibs can be provided for use on babies during feeding. Disposable bibs can have a laminate construction comprising multiple layers. For instance, disposable bibs can include an absorbent paper or nonwoven topsheet for receiving spilled food material and a plastic film backsheet for preventing penetration of spilled liquids through the bib and onto the baby's clothing. Other multiple layer bib constructions are also known.

The prior art also discloses bibs having a pocket structure for receiving solids or liquids that would otherwise soil the wearer's clothing. An example of a bib having such a pocket is disclosed in U.S. Pat. No. 4,445,231 issued May 1, 1984 to Noel. Noel discloses a bib having a gravitationally openable pocket. Noel provides an improvement in pocket structures for use with bibs. However, Noel depends on gravitational forces acting on an apron panel to maintain a bib pocket in an open configuration. The effectiveness of such a design can be affected by the vertical orientation of the wearer and/or the bib.

Another example of a disposable bib having a pocket structure for receiving solids or liquids is disclosed in U.S. Pat. No. 6,128,780 issued Oct. 10, 2000 to Reinhart, et al. Reinhart et al. provides a bib having a bib body comprising a first body panel, a second pocket panel, and a third panel. The second pocket panel is joined to the body panel for providing a pocket space intermediate the body panel and the pocket panel. The pocket space has a pocket open edge. The third panel is joined to the pocket open edge to extend at least partially into the pocket space, with at least a portion of the third panel being disposed between the body panel and the pocket panel. Disposition of the third panel between the pocket panel and the body panel serves to space at least a portion of the pocket panel from an underlying portion of the body panel to provide opening of the pocket space along the longitudinal centerline of the bib. However, the opening of the pocket may be deflected close by a wearer leaning against a tray or table during use, making the pocket ineffective during use.

Accordingly, there remains a need for an inexpensive disposable bib having a pocket that can be maintained in an open configuration for receiving and holding spilled solid and liquid food material. Particularly, there is a need for a disposable bib having a pocket capable of maintaining the open configuration even when subjected to normal forces induced during use.

SUMMARY OF THE INVENTION

The present invention provides a disposable bib. The bib can comprise a bib body and a pair of shoulder extensions extending from the bib body to define a neck opening. The bib body can have a longitudinal length, a longitudinal centerline, and a lateral width.

The bib body comprises a first body panel, a second pocket panel, and a third panel. The second pocket panel is joined to the body panel for providing a pocket space intermediate the body panel and the pocket panel. The pocket space has a pocket open edge, a pocket longitudinal length, and a pocket lateral width. The third panel includes a first end joined to the pocket open edge and a laterally extending second end spaced from the first end. The third panel is made to extend at least partially into the pocket space, with at least a portion of the third panel being disposed between the body panel and the pocket panel in order to space at least a portion of the pocket panel from the outer surface of the body panel.

The third panel preferably has a lateral width that is greater than the lateral width of the pocket space. Such an arrangement provides the advantage that at least a portion of the third panel is deformed from a planar configuration, such as by folding or wrinkling, as it is disposed in the pocket space. Such deformation of the third panel aids in spacing the pocket panel from the body panel. However, alternatively, the third panel can have a lateral width which is substantially equal to the lateral width of the pocket space. In addition, the third panel can have a longitudinal length which is less than, or substantially equal to, the longitudinal length of the pocket space.

In order to provide a sustained pocket space, a flexible member is provided. The flexible member may be formed by doubling a section of the third panel at least once and bonding the doubled section. The third panel and the flexible member are constructed and arranged such that as the third panel is folded or defected into the pocket space from a first position having an inside surface facing an outer surface of the body panel to a second position having the inside surface of the third panel facing an inside surface of the pocket panel, the third panel provides an opening of the pocket space along the longitudinal centerline of the bib. The flexible member is more rigid than the third panel and provides a durable pocket opening that is maintained during use.

In one embodiment, the third panel further comprises at least two hinge lines extending longitudinally between the first end and the second end, laterally spaced intermediate and equidistant the longitudinally extending side edges. The hinge lines may comprise indentations or perforations extending into the flexible member. Once the third panel is positioned inside the pocket space, the hinge lines allow the flexible member to deflect open the pocket space in a multi-planar configuration providing support which helps to maintain the opening of the pocket space even when subjected to normal forces induced during normal use.

BRIEF DESCRIPTION OF THE DRAWINGS

While the specification concludes with claims particularly pointing out and distinctly claiming the present invention, the invention will be better understood from the following description taken in conjunction with the accompanying drawings in which like designations are used to designate substantially identical elements, and in which:

DETAILED DESCRIPTION OF THE INVENTION

Figure 1:
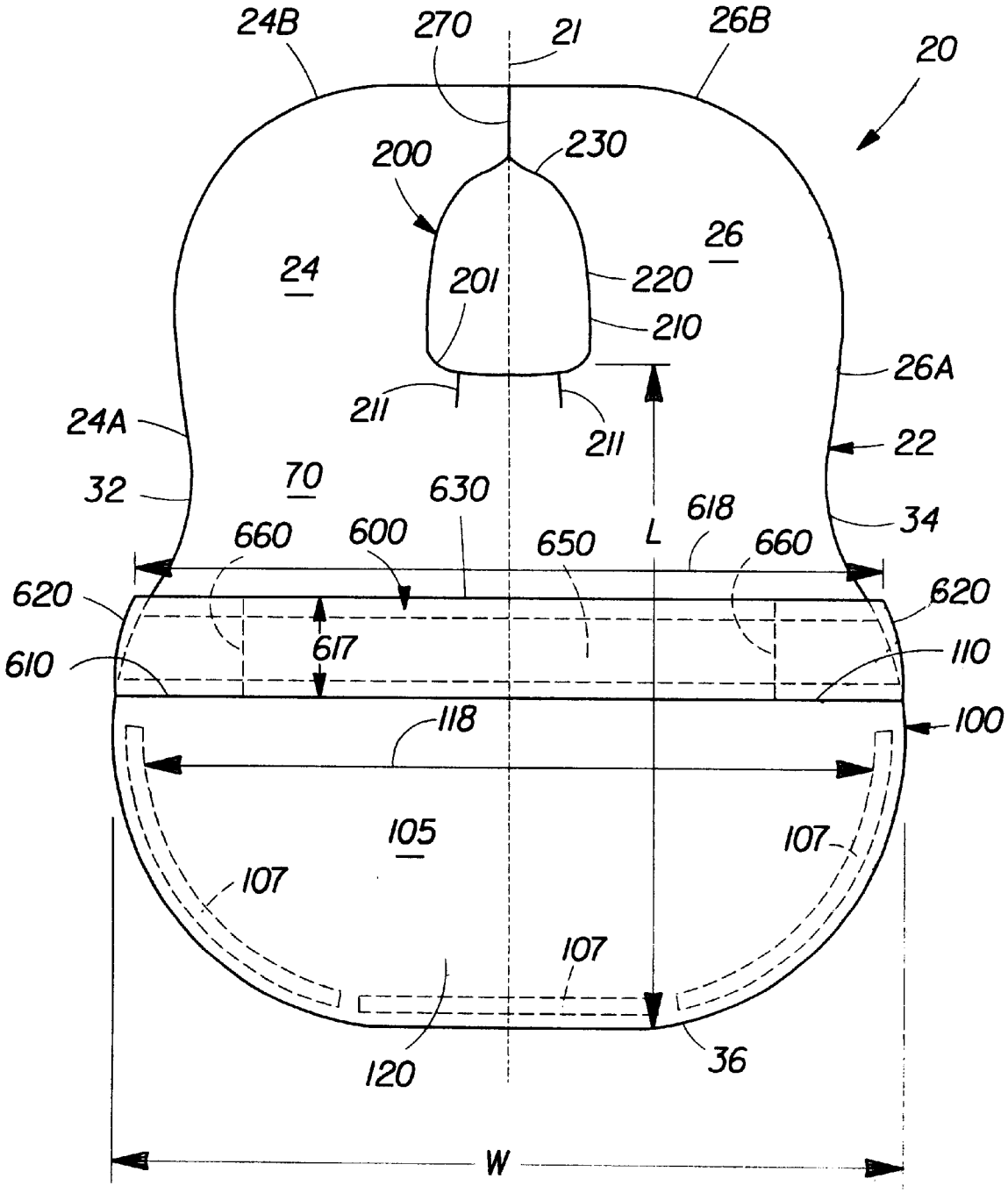
FIG. 1 is perspective view of a disposable bib according to the present invention.

FIG. 1 illustrates a disposable bib 20 according to one embodiment of the present invention. By "disposable" it is meant that the bib is meant to be used once, and then discarded. The disposable bib 20 comprises a bib body 22 having longitudinally extending sides 32 and 34, a longitudinal length L, a longitudinal centerline 21, a laterally extending bottom edge 36, and a lateral width W.

The term "longitudinal" refers to an axis or direction measured along the length of the bib body 22, which direction or axis is generally parallel to a line extending from the wearer's head to the wearer's waist, as the bib is worn. The terms "lateral" and "transverse" refer to a direction or axis which is perpendicular to the longitudinal centerline 21, and which is generally parallel to a line extending across the wearer's chest as the bib is worn.

Figure 2:
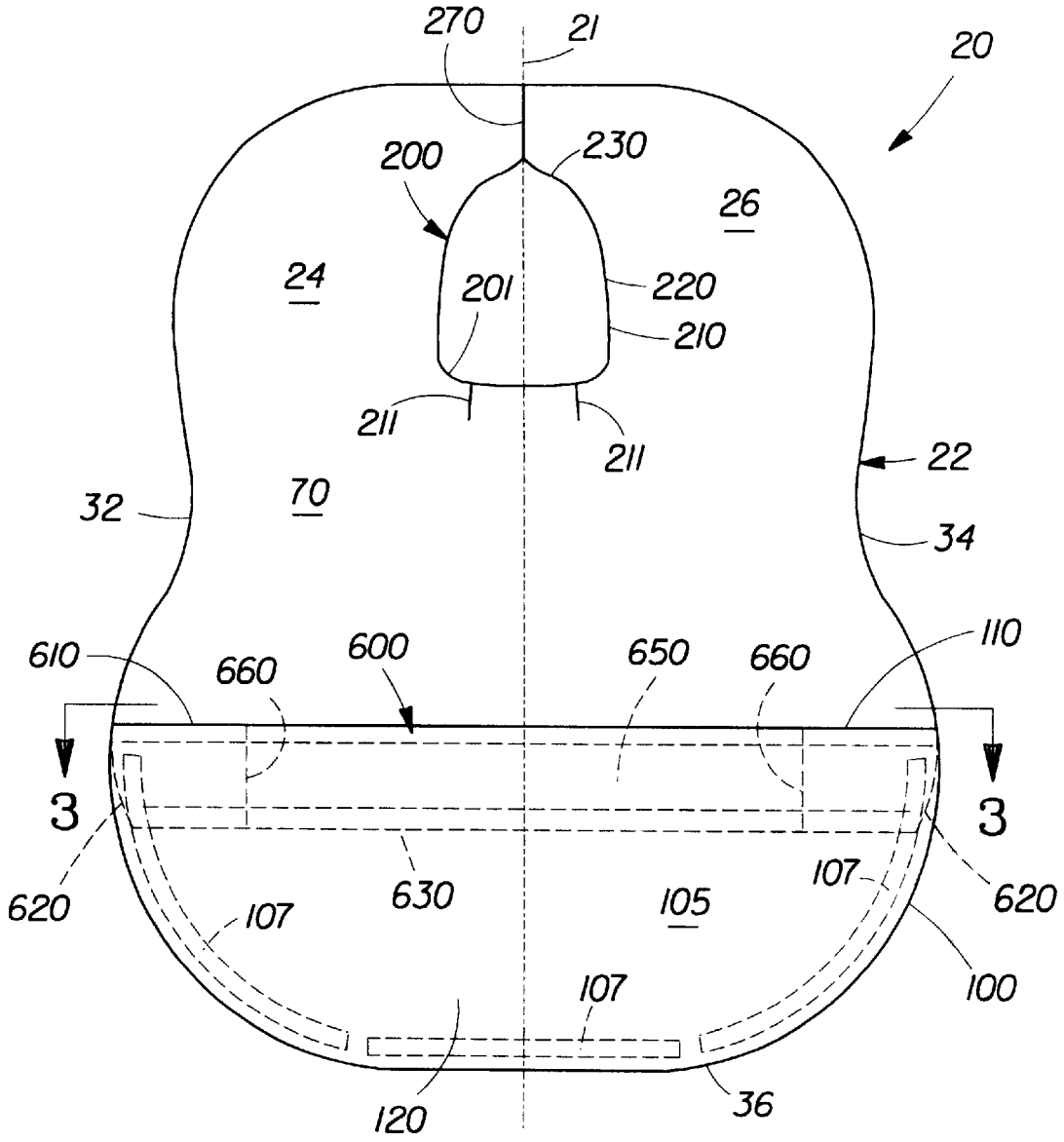
FIG. 2 is an in use view of the disposable bib of FIG. 1 with the third panel folded into the pocket space.
Figure 3:
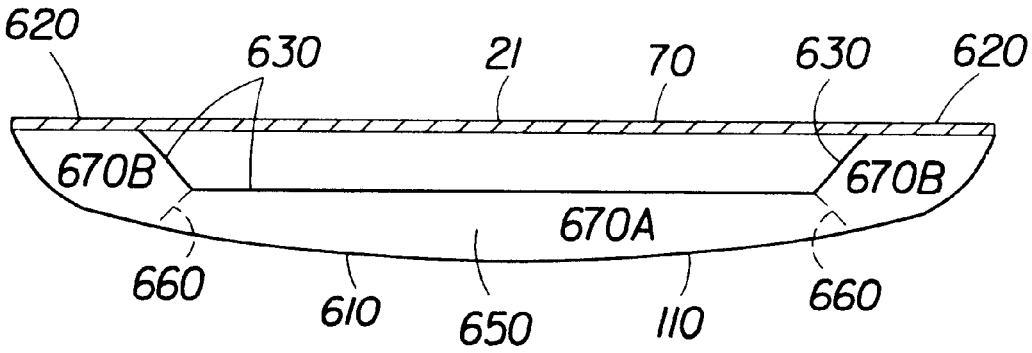
FIG. 3 is a top view of the disposable bib of FIG. 2 showing the pocket space with the third panel folded into the pocket space.

The bib 20 includes a pocket 100, for catching and receiving food particles. The bib body 22 comprises a first body panel 70, a second pocket panel 105, and a third panel 600. The body panel 70 is disposed adjacent the wearer's body when the bib is secured to the wearer. The pocket panel 105 can have a generally rectangular shape or alternatively, as shown in FIGS. 2 and 3, can have a generally elliptical shape. The pocket panel 105 together with the body panel 70 forms a pocket 100 comprising a pocket space intermediate the body panel 70 and the pocket panel 105. The third panel 600 is joined to the pocket panel 105 and can be folded or deflected into the pocket 100 to be disposed intermediate the body panel 70 and the pocket panel 105 as shown in FIG. 2 and 3.

The pocket panel 105 extends longitudinally from a pocket bottom edge 120, which can also be the bib bottom edge 36, to a pocket open edge 110. The longitudinal length of the pocket space is measured along the longitudinal centerline 21 from the bottom edge 120 to the pocket open edge 110. Reference number 117 designates the longitudinal length of the pocket space. The bottom edge 120 and the open edge 110 can both be substantially perpendicular to the longitudinal centerline 21 and substantially parallel to an imaginary lateral axis.

The pocket panel 105 extends laterally intermediate the bib side edges 32 and 34. The pocket panel 105 is joined to the underlying body panel 70 along the edges 32 and 34 at attachment zones designated by reference number 107. A securing means, such as adhesive, can be used to join the side edges of the pocket panel 105 to the body panel 70 in the attachment zones 107. The pocket space has a lateral width designated by reference number 118. The lateral width 118 of the pocket space corresponds to the minimum lateral spacing between the attachment zones 107.

The third panel 600 is joined to a portion of the bib 20 and can be folded to extend at least partially into the pocket space intermediate the body panel 70 and the pocket panel 105. In one embodiment, the body panel 70, pocket panel 105, and third panel 600 can be formed from a continuous sheet of material, and the sheet of material may comprise one or more laminae. Alternatively, the pocket panel and the third panel can be formed from a continuous sheet separate from the body panel. The pocket panel 105 can be joined to the body panel 70 at a laterally extending fold in the sheet material corresponding to the bib bottom edge 36. Alternatively, the third panel 600 can be joined to the pocket panel 105 by a laterally extending fold in the sheet material which corresponds to the pocket open edge 110.

The third panel 600 can have the shape of a quadrilateral, and more particularly, the third panel 600 can have a generally rectangular shape. The third panel 600 can have a first end 610 joined to the pocket panel 105 at the open edge 110. The third panel 600 can have a laterally extending second end 630, which is spaced longitudinally from the first end 610. The third panel 600 can also have longitudinally extending side edges 620 which extend from the first end 610 to the second end 630 of the third panel 600. The second end 630 and side edges 620 are free edges that are unattached to other portions of the bib 20.

The third panel 600 spaces at least a portion of the pocket panel 105 from an underlying portion of the body panel 70 to provide opening of the pocket space along the longitudinal centerline 21. In particular, at least a portion of the third panel 600 extending into the pocket 100 can be deformed from a planar configuration, such as by folding or wrinkling, to provide spacing of a portion of the pocket panel 105 from the body panel 70.

Preferably, the third panel 600 has a lateral width, which is sized, relative to the pocket space to promote deformation of the third panel 600 when the third panel is positioned between the body panel 70 and the pocket panel 105. The third panel 600 preferably has a lateral width, which is greater than the lateral width 118 of the pocket space. The third panel 600 has a lateral width designated by reference number 618 in FIG. 1. When the third panel 600 is disposed in the pocket space, the third panel 600 is deflected causing it to deform from a planar configuration, due to the difference between the width 618 and the width 118. This deformation is illustrated in FIG. 3, which shows the third panel 600 disposed between a portion of the pocket panel 105 and the body panel 70 such that the longitudinal centerline of the third panel 600 is deflected away from the longitudinal centerline 21 of the bib body panel 70. Such deformation of the third panel helps maintain the pocket 100 in an open configuration.

The third panel 600 has a longitudinal length designated by reference number 617 in FIG. 1. The third panel 600 can have a longitudinal length which is less than, or substantially equal to, the longitudinal length 117 of the pocket space. The third panel 600 can have a longitudinal length, which is at least 50 percent of the length 117, but less than 100 percent of the length 117. Alternatively, the third panel 600 can have a longitudinal length, which is less than 50 percent of the length 117.

The third panel 600 includes a flexible member 650 attached to an inside surface of the third panel 600, extending laterally between the longitudinally extending side edges 620. The flexible member 650 helps to maintain the pocket space during use by adding rigidity and flexibility to the open edge 110 pocket panel 105. The flexible member 650 is capable of deflecting during use when the pocket panel 105 is subjected loading which causes the pocket space to collapse and springing back to restore the pocket space once the force is removed.

The flexible member 650 is preferably attached proximate the first end 610 of the third panel 600 so that when the third panel 600 is positioned in the pocket space, the flexible member 650 is adjacent to the open edge 110 of the pocket 100. Flexible member 650 may extend the entire longitudinal length 617 of the third panel 600 or just a portion of the longitudinal length 617. In addition to adding rigidity to the pocket panel 105, the flexible member 650 can also be absorbent, providing an additional function of absorbing spills during use.

The flexible member 650 may comprise 0.62 mil polyethylene foam manufactured by Sealed Air Corp. Alternatively, the flexible member 650 may comprise a polymeric film, a nonwoven, a sponge, foam, adhesive film, or adhesive filler.

In an alternate embodiment, the flexible member 650 comprises a doubled section 700 comprising a section of the third panel 600 that is folded at least once and bonded so that each successive layer making up the doubled section are attached. The bonds include bond patterns selected to provide maximum resistance to collapse or bending. The bond patterns can include intermittent bond sites disposed at discrete locations along the doubled section 700 or unbroken continuous bonds extending laterally across the width of the doubled section, which, for this embodiment, is equal to the lateral width 618 of the third panel 600. The bond patterns can be formed via adhesive bonds, ultrasonic bonds, infrared bonds, pressure bonds, thermal bonds, and any alternative bonding approaches known to those skilled in the art. In alternate embodiments, the bond patterns may form the shape of a products logo or Trademark.

Figure 4A:
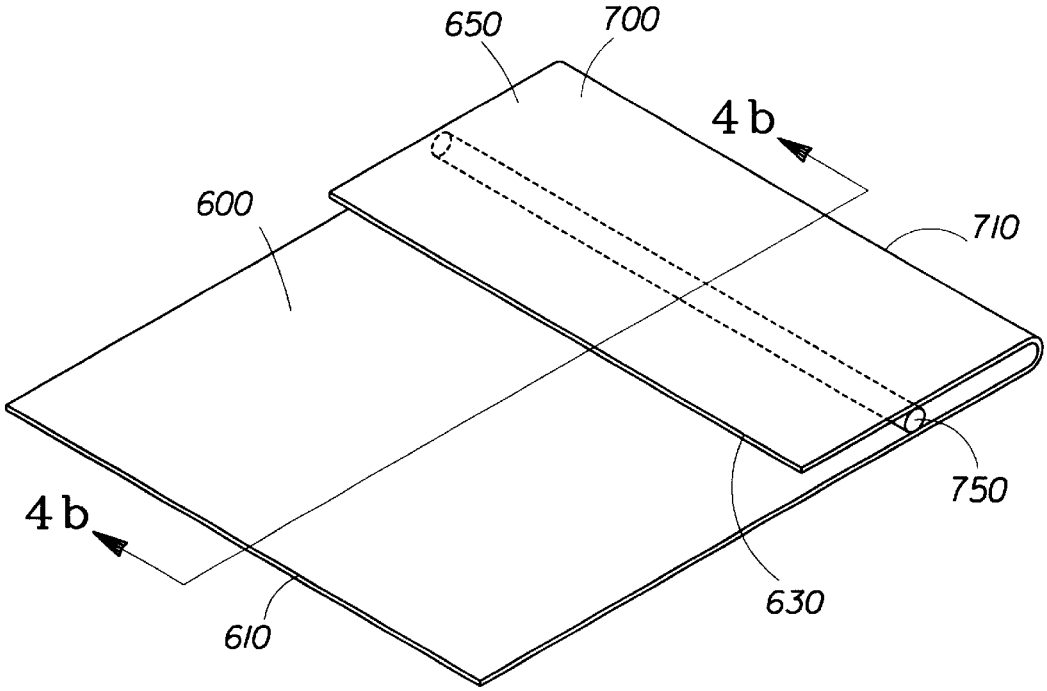
FIG. 4*a* is a perspective view of the third panel of the disposable bib according to the present invention where the flexible member comprises a doubled section including a first folded edge of the third panel generally parallel to the first end of the third panel and a continuous bond penetrating through the doubled section spanning the lateral width of the doubled section.
Figure 4B:
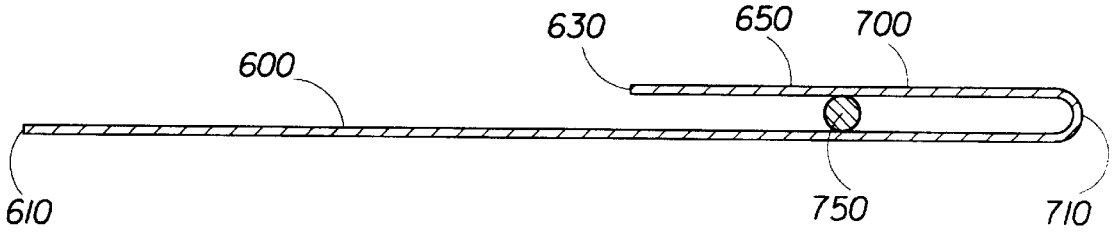
FIG. 4*b* is a cross sectional view of the doubled section shown in FIG. 4*a*.
Figure 5A:
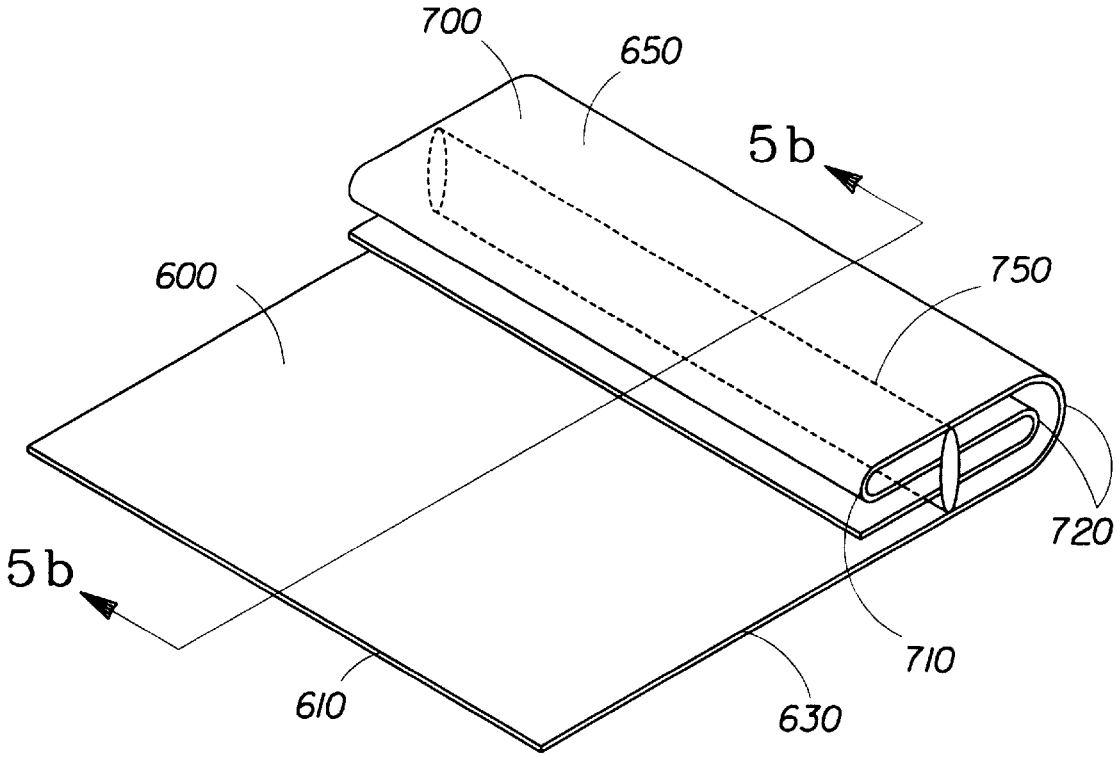
FIG. 5*a* is a perspective view of the third panel of the disposable bib according to the present invention where the flexible member comprises a doubled section including a first folded edge of the third panel generally parallel to the first end of the third panel, a second folded edge generally parallel to the first end placing the first folded edge adjacent to the second end of the third panel and a continuous bond penetrating through the doubled section and spanning the lateral width of the doubled section.
Figure 5B:
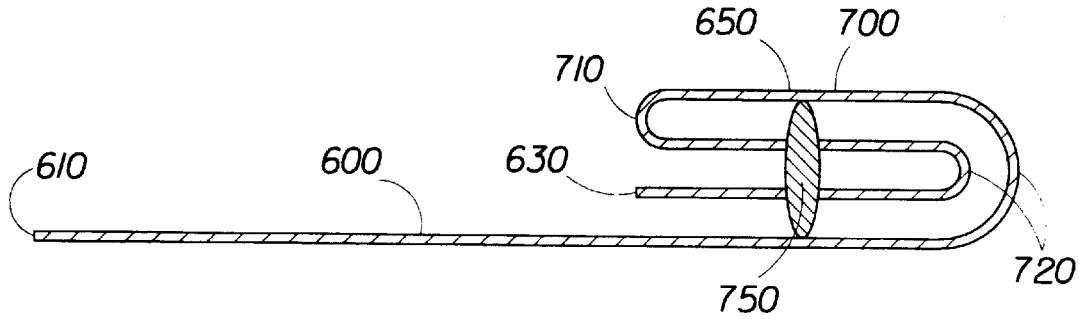
FIG. 5*b* is a cross sectional view of the doubled section shown in FIG. 5*a*.
Figure 6A:
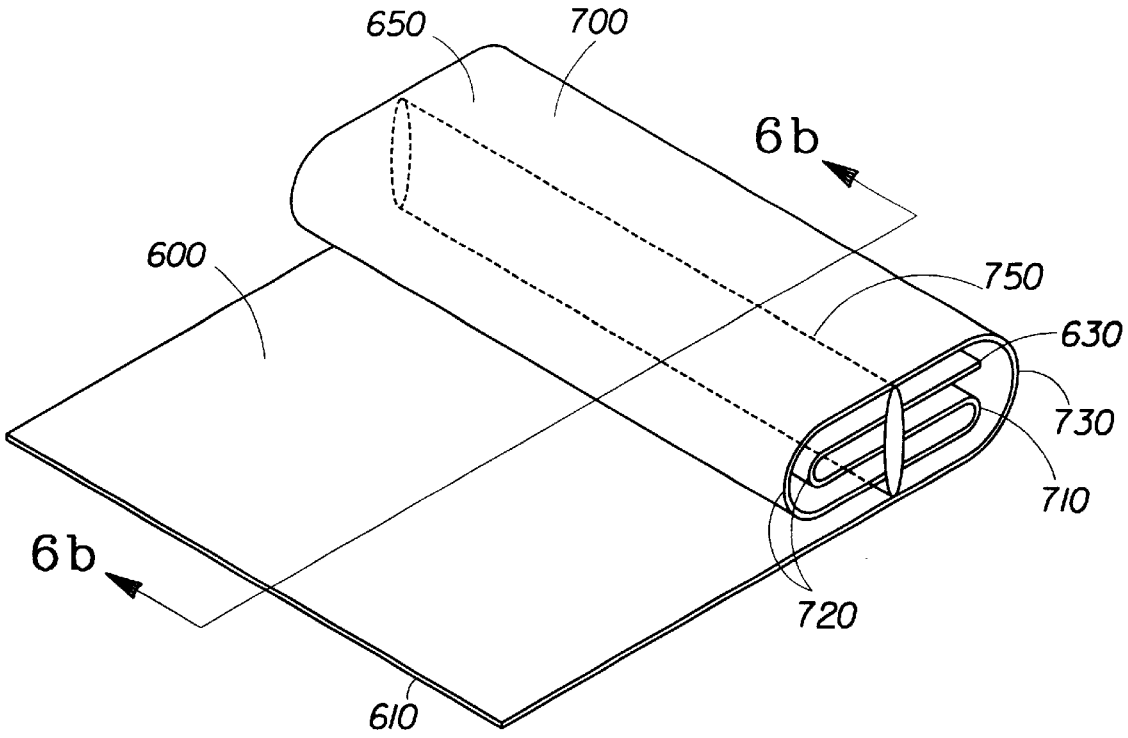
FIG. 6*a* is a perspective view of the third panel of the disposable bib according to the present invention where the flexible member comprises a doubled section including a first folded edge of the third panel generally parallel to the first end of the third panel, a second folded edge generally parallel to the first end placing the first folded edge adjacent to the second end of the third panel, a third folded edge parallel to the first end where the third folded edge is formed adjacent to the first folded edge and the second end of the third panel and a continuous bond penetrating through the doubled section and spanning the lateral width of the doubled section.
Figure 6B:
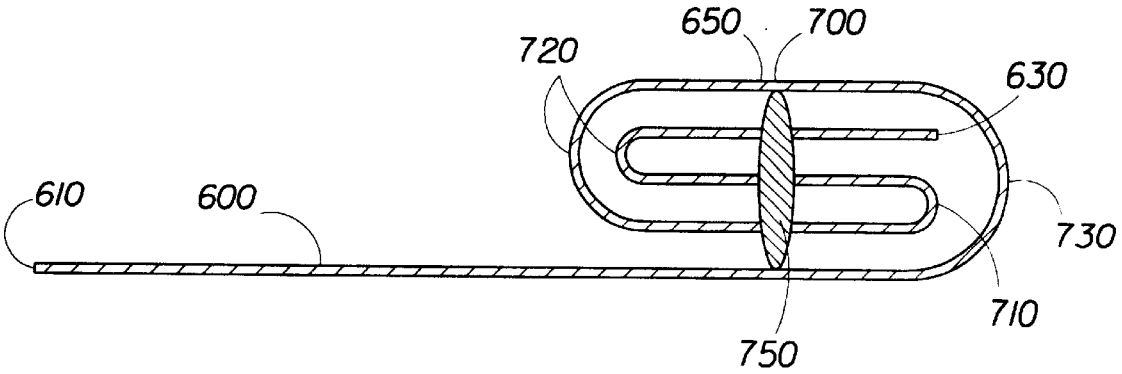
FIG. 6*b* is a cross sectional view of the doubled section shown in FIG. 6*a*.

Generally, the doubled section 700 may be formed by folding over the second end 630 of the third panel 600 one time creating a first folded edge 710 that is generally parallel to the first end 610 of the third panel 600 as shown in FIGS. 4*a* and 4*b*. In an alternate embodiment, the doubled section 700 can comprise at least two folds where the first folded edge 710 of the doubled section 700 shown in FIGS. 4*a* and 4*b* is folded over forming a second folded edge 720 that is parallel to the first folded edge 710 placing the first folded edge 710 adjacent to the second end 630 of the third panel 600 as shown in FIGS. 5*a* and 5*b*. Further, in another embodiment, the doubled section 600 can comprise at least three folds where the second folded edge 720 of the doubled section 700 shown in FIGS. 5*a* and 5*b* is folded over forming a third folded edge 730. For this embodiment, the third folded edge 730 is preferably adjacent to both the first folded edge 710 of the doubled section 700 and the second end 630 of the third panel 600, as shown in FIGS. 6*a* and 6*b*, so that the second end 630 of the third panel 600 and first folded edge 710 of the doubled section 600 are not exposed. For each of these embodiments, the doubled section 700 includes a bond pattern 750 penetrating through the doubled section 700 attaching each successive layer making up the doubled section 700.

In addition to the flexible member 650, the third panel 600 may comprise hinge lines 660 extending longitudinally, at least partially, between the first end 610 and the second end 630 of the third panel 600. Preferably, the hinge lines 660 extend from the first end 610 to the second end 630 of the third panel 630. The hinge lines 660 comprise indentations or creases that extend into the flexible member 650. The hinge lines 660 in combination with the flexible member 650 create a multi-planar pocket panel 105 that can enhance the ability of the third panel 600 to maintain the pocket space in an open configuration during use.

Although any number of hinge lines 660 may be provided, the third panel 600 preferably includes at least two hinge lines 660 disposed equidistant from the longitudinally extending side edges 620 of the third panel 630 as shown in FIGS. 1, 2, and 3. Once the third panel 600 is positioned in the pocket space, the hinge lines 660 separate the third panel 600 into three planes, one middle plane 670A and two side planes 670B adjacent the longitudinally extending side edges 620. The two side planes 670B are oriented at an angle relative to the first body panel 70 and provide support for the middle plane 670A such that the deflection of the pocket panel 105 resulting from loads applied normal to the middle plane 670A is primarily limited to the middle plane 670A with minimal deflection in the form of buckling occurring with the side planes 670B. This arrangement in combination with the flexible member 650 increases the rigidity of the pocket panel 105.

The bib 20 also comprises a pair of shoulder extensions 24, 26 having proximal ends 24A, 26A and distal ends 24B, 26B. The shoulder extensions 24, 26 extend from the bib body 22 from their proximal ends to their distal ends to provide a generally planar neck opening 200 when the bib is supported on a flat, horizontal surface.

The bib 20 also preferably comprises a fastening assembly for joining together the shoulder extensions 24 and 26 in an overlapping fashion, to thereby secure the bib 20 to the wearer. The fastening assembly can comprise a mechanical fastener having elements disposed on at least one of the shoulder extensions, which elements penetrate and physically engage a landing surface on the other shoulder extension. In one embodiment, the fastener can comprise an array of projections extending from a substrate joined to the shoulder extension 26. The projections are engagable with a landing surface, the landing surface being disposed on at least a portion of the shoulder extension 24.

The generally planar neck opening 200 has a front neck portion 210, a rear neck portion 230, and a maximum width portion 220 disposed intermediate the front neck portion 210 and the rear neck portion 230.

A plurality of slits 211 can extend in a generally radial fashion from the perimeter 201 of the front neck-opening portion 210. The slits 211 provide a close yet comfortable fit of the perimeter 210 of front neck opening portion 210 against the wearer's neck. The slits 211 allow the resulting petal like portions of bib intermediate the slits 211 to slide over each other as the shoulder extensions 24, 26 are overlapped. The slits 211 thereby help reduce distortion and gapping of the bib body as the neck opening 200 is made to conform to the wearer's neck. Accordingly, the slits 211 cooperate with the shape of the neck opening 200 to improve fit of the bib about the wearer's neck, and reduce distortion and gapping of the bib body as the shoulder extensions 24, 26 are overlapped to accommodate a particular neck size. Such slits, or bifurcations, are disclosed generally in U.S. Pat. No. 4,416,025 to Moret, which Patent is incorporated herein by reference.

Referring to the components of the bib 20 in more detail, the bib 20 according to the present invention can comprise a composite construction having multiple laminae. The bib 20 can comprise a laminate of a nonwoven outer layer, an absorbent tissue inner layer, and a garment facing backsheet layer which is liquid impermeable relative to the topsheet. The topsheet has a first outer surface for receiving spilled food material, and a second inner surface joined to the inner tissue layer. The backsheet has a first garment facing surface and a second surface joined to the inner tissue layer. The surface of the backsheet and the surface of the topsheet are oppositely facing surfaces, and can be joined to the tissue layer, such as with an adhesive, to form a laminate. In one embodiment, the shoulder extensions 24, 26, the bib body panel 70, the pocket panel 105, and the third panel 600 are formed from a single, continuous sheet of the laminate of the topsheet, tissue layer, and the backsheet. In a preferred embodiment, the shoulder extensions 24, 26, and the bib body panel 70 are formed from a single, continuous sheet of the laminate of the topsheet, tissue layer, and the backsheet, while the pocket panel and third panel are formed from continuous sheet of nonwoven which is bonded to the outer facing surface of the body panel.

The topsheet can comprise hydrophilic nonwoven. A suitable nonwoven can comprise a triple beam spunbond spunbond spunbond material having a basis weigh ranging from 13.5–27.0 grams/Meter$^2$ manufactured by First Quality Non-wovens, Hazelton, Pa.

The backsheet can comprise a liquid impervious polymeric film, such as a polyethylene film having a thickness of between about 0.65 mil (0.00065 inch) and about 2.0 mils (0.002 inch). In one embodiment the backsheet can comprise a polyethylene film having a thickness of about 0.85 mils and manufactured under the designation DH216 by Clopay Polyethylene Film, Cincinnati, Ohio.

The tissue layer can comprise a cellulose tissue layer having a basis weight ranging from 20.0–44.0 grams/Meter$^2$. In one embodiment the tissue layer can comprise a single-ply cellulose tissue layer having a basis weight of about 32.6 grams/Meter$^2$ manufactured by Cellu-Tissue, Wiggins, Miss.

The combination third panel and pocket panel can comprise liquid impermeable nonwoven. In one embodiment the combination third panel and pocket panel comprises spunbond, meltblown, meltblown, spunbond nonwoven having a basis weight of about 15 grams/Meter$^2$ manufactured by First Quality Non-wovens, Hazelton, Pa.

The topsheet and the backsheet can be joined to the tissue layer in any suitable manner, including but not limited to methods such as adhesive bonding, mechanical bonding, and ultrasonic bonding. A suitable adhesive for joining the topsheet and the backsheet is a hot melt adhesive such as a hot melt pressure sensitive adhesive. One particular adhesive which is suitable for joining the topsheet to the backsheet is an HL-1258 adhesive manufactured by H. B. Fuller Co. of St. Paul, Minn. Other suitable adhesives include Findley Adhesives H2031 and H2120 available from Findley Adhesives of Elmgrove, Wis.

Prior to the time the bib is to be used, the shoulder extensions 24 and 26 can be joined together, such as at their distal ends 24B, 26B, along a selective line of weakening 270. When the bib is to be used, the shoulder extensions are separable along the selective line of weakening 270, such that the shoulder extensions can be separated without tearing or otherwise damaging other portions of the bib, and releasably joined together in an overlapping fashion by the fastening assembly.

In one embodiment, the selective line of weakening 270 is aligned with the longitudinal centerline 21, and comprises a plurality of spaced apart perforations. The perforations extend partially or fully through the thickness of the bib 200. The perforations can be formed with a perforating knife, and can extend through each of the backsheet, topsheet, and nonwoven web.

The selective line of weakening 270 provides the advantage that the distal ends of the shoulder extensions are interconnected, rather than loose, prior to use. The bib is therefore easier to handle prior to use. In addition, the use of a selective line of weakening provides for ease of manufacturing. For instance, the bibs 20 can be manufactured by joining together continuous webs of the backsheet material, the topsheet material, and the nonwoven material to form a continuous, multiple laminae sheet. The multiple laminae sheet can then be perforated at predetermined positions corresponding to the desired location of each bib to be cut from the sheet. The bibs can then be cut from the sheet according to a predetermined pattern. Accordingly, there is no need to attempt to position or support loose distal ends of the shoulder extensions during manufacturing.

While particular embodiments and/or individual features of the present invention have been illustrated and described, it would be obvious to those skilled in the art that various other changes and modifications can be made without departing from the spirit and scope of the invention. Further, it should be apparent that all combinations of such embodiments and features are possible and can result in preferred executions of the invention. Therefore, the appended claims are intended to cover all such changes and modifications that are within the scope of this invention.

What is claimed:

1. A disposable bib comprising:

a first body panel having a body facing surface and an outer facing surface, a longitudinal centerline, a lateral width, and longitudinally extending side edges;

a second pocket panel joined to the body panel for providing a pocket space intermediate the outer facing surface of the body panel and an inner surface of the pocket panel, the pocket space having a pocket open edge, a pocket longitudinal length and a pocket lateral width;

a third panel having an inside surface and an outside surface, a first end joined to the pocket open edge, a laterally extending second end spaced from the first end and having a lateral width extending between longitudinally extending side edges; and a flexible member comprising a doubled section, the doubled section including at least a first folded edge of the third panel generally parallel to the first end of the third panel, and a bond pattern penetrating through the doubled section, the flexible member having an inside surface and an outside surface, wherein the flexible member is constructed and arranged such that as the flexible member is deflected into the pocket space from a first position having the inside surface of the flexible member facing the outer surface of the body panel to a second position having the inside surface of the flexible member facing the inside surface of the pocket panel, the flexible member spaces at least a portion of the pocket panel from the outer surface of the body panel to provide opening of the pocket space along the longitudinal centerline of the bib.

2. The disposable bib of claim 1 wherein the doubled section further comprises a second folded edge of the third panel generally parallel to the first end of the third panel, wherein the first folded edge is adjacent to the second end of the third panel.

3. The disposable bib of claim 2 wherein the doubled section further comprises a third folded edge of the third panel generally parallel to the first end of the third panel, wherein the third folded edge is adjacent to the first folded edge and the second end of the third panel.

4. The disposable bib of claim 1 wherein the third panel further comprises at least two hinge lines extending at least partially longitudinally between the first end and the second end, laterally spaced intermediate and equidistant the longitudinally extending side edges.

5. The disposable bib of claim 4 wherein the at least two hinge lines are spaced from the longitudinally extending side edges of the third panel a distance ranging from about 35 mm to about 55 mm.

6. The disposable bib of claim 4 wherein the at least two hinge lines are separated by a distance ranging from about 125 mm to about 165 mm.

7. The disposable bib of claim 4 wherein the at least two hinge lines comprise indentations or creases extending into the flexible member.

8. The disposable bib of claim 4 wherein the at least two hinge lines comprise perforations extending into the flexible member.

9. The disposable bib of claim 1 wherein the third panel has a lateral width greater than the lateral width of the pocket space.

10. The disposable bib of claim 1 the bond pattern is selected from the group consisting of adhesive bonds, ultrasonic bonds, infrared bonds, pressure bonds and thermal bonds.

11. The disposable bib of claim 1 wherein the flexible member is more rigid than the third panel.

12. A disposable bib having a longitudinal centerline, a lateral width, and longitudinally extending side edges, the disposable bib comprising:

a first body panel having a liquid pervious outer facing layer, a liquid impervious body facing layer, and an absorbent layer disposed therebetween;

a second pocket panel joined to the body panel for providing a pocket space intermediate the outer facing surface of the body panel and an inner surface of the pocket panel, the pocket space having a pocket open edge, a pocket longitudinal length and a pocket lateral width; and a third panel having an inside surface and an outside surface, a first end joined to the pocket open edge, a laterally extending second end spaced from the first end and having a lateral width extending between longitudinally extending side edges; and a flexible member comprising a doubled section, the doubled section including at least a first folded edge of the third panel generally parallel to the first end of the third panel, and a bond pattern penetrating through the doubled section, the flexible member having an inside surface and an outside surface, wherein the flexible member is constructed and arranged such that as the flexible member is deflected into the pocket space from a first position having the inside surface of the flexible member facing the outer surface of the body panel to a second position having the inside surface of the flexible member facing the inside surface of the pocket panel, the flexible member spaces at least a portion of the pocket panel from the outside surface of the body panel to provide opening of the pocket space along the longitudinal centerline of the bib.

13. The disposable bib of claim 12 wherein the doubled section further comprises a second folded edge of the third panel generally parallel to the first end of the third panel, wherein the first folded edge is adjacent to the second end of the third panel.

14. The disposable bib of claim 13 wherein the doubled section further comprises a third folded edge of the third panel generally parallel to the first end of the third panel, wherein the third folded edge is adjacent to the first folded edge and the second end of the third panel.

15. The disposable bib of claim 12 wherein the third panel further comprises at least two hinge lines extending longitudinally between the first end and the second end, laterally spaced intermediate and equidistant the longitudinally extending side edges.

16. The disposable bib of claim 15 wherein the at least two hinge lines are spaced from the longitudinally extending side edges a distance ranging from about 35 mm to about 55 mm.

17. The disposable bib of claim 15 wherein the at least two hinge lines are separated by a distance ranging from about 125 mm to about 165 mm.

18. The disposable bib of claim 15 wherein the at least two hinge lines include indentations, creases, or perforations extending into the flexible member.

19. The disposable bib of claim 12 wherein the lateral width of the third panel is greater than the lateral width of the pocket space.

20. The disposable bib of claim 12 wherein the bond pattern is selected from the group consisting of adhesive bonds, ultrasonic bonds, infrared bonds, pressure bonds, and thermal bonds.

* * * * *